US010549178B2

(12) United States Patent
Shigeta

(10) Patent No.: US 10,549,178 B2
(45) **Date of Patent: *Feb. 4, 2020**

(54) CARD SHOOTER DEVICE AND METHOD

(71) Applicant: Angel Playing Cards Co., Ltd., Shiga (JP)

(72) Inventor: Yasushi Shigeta, Shiga (JP)

(73) Assignee: ANGEL PLAYING CARDS CO., LTD., Shiga (JP)

( * ) Notice: Subject to any disclaimer, the term of this patent is extended or adjusted under 35 U.S.C. 154(b) by 101 days.

This patent is subject to a terminal disclaimer.

(21) Appl. No.: 15/465,444

(22) Filed: Mar. 21, 2017

(65) Prior Publication Data

US 2017/0189792 A1 Jul. 6, 2017

Related U.S. Application Data

(63) Continuation of application No. 14/621,099, filed on Feb. 12, 2015, now Pat. No. 9,649,550, which is a (Continued)

(51) Int. Cl.
*A63F 1/14* (2006.01)

(52) U.S. Cl.
CPC ..... *A63F 1/14* (2013.01); *A63F 2250/58* (2013.01)

(58) Field of Classification Search
CPC ..... A63F 1/12

(Continued)

(56) References Cited

U.S. PATENT DOCUMENTS 4,513,696 A 4/1985 Fujii et al.
4,513,969 A 4/1985 Samsel, Jr.

(Continued)

FOREIGN PATENT DOCUMENTS

AU 2013203307 B2 4/2014
CN 101437586 A 5/2009

(Continued)

OTHER PUBLICATIONS

Australian Patent Examination Report No. 1, Australian Patent Application No. 2013203307, dated Oct. 15, 2014.

(Continued)

*Primary Examiner* — John E Simms, Jr.
*Assistant Examiner* — Dolores R Collins
(74) *Attorney, Agent, or Firm* — Norton Rose Fulbright US LLP

(57) ABSTRACT

A card shoe apparatus including a card housing unit for housing a plurality of cards; an opening in the card housing unit for manually withdrawing the cards one by one from the card housing unit in a card reading direction; a card reading unit that reads information on the cards as the cards are manually withdrawn from the card housing unit in the card reading direction; a control unit that stores rules of a card game and determines the results of the card game based on the information read by the card reading unit and the rules of the card game; an optical device that detects movements of the cards relative to the card reading direction; and a card entry/exit restriction unit provided in the opening. The card entry/exit restriction unit restricts the entry or exit of any of the cards when the cards are improperly withdrawn from the opening.

27 Claims, 5 Drawing Sheets

Related U.S. Application Data continuation of application No. 14/419,605, filed as application No. PCT/JP2012/006230 on Sep. 28, 2012, now Pat. No. 10,343,055.

(58) Field of Classification Search
USPC ..... 273/149
See application file for complete search history.

(56) References Cited

U.S. PATENT DOCUMENTS

| | | | | |
|---|---|---|---|---|
| 4,534,562 | A | 8/1985 | Cuff et al. | |
| 4,586,712 | A | 5/1986 | Lorber et al. | |
| 4,794,239 | A | 12/1988 | Allais | |
| 5,067,713 | A | 11/1991 | Soules et al. | |
| 5,166,502 | A | 11/1992 | Rendleman et al. | |
| 5,169,155 | A | 12/1992 | Soules et al. | |
| 5,259,907 | A | 11/1993 | Soules et al. | |
| 5,331,141 | A | 7/1994 | Kaneko | |
| 5,374,061 | A | 12/1994 | Albrecht | |
| 5,669,813 | A * | 9/1997 | Jairazbhoy | B60H 1/00271 361/645 |
| 5,669,816 | A | 9/1997 | Garczynski et al. | |
| 5,707,287 | A | 1/1998 | McCrea, Jr. | |
| 5,722,893 | A * | 3/1998 | Hill | A63F 1/14 273/149 R |
| 5,779,546 | A | 7/1998 | Meissner | |
| 5,814,804 | A | 9/1998 | Kostizak | |
| 5,911,626 | A | 6/1999 | McCrea, Jr. | |
| 5,941,769 | A | 8/1999 | Order | |
| 6,039,650 | A * | 3/2000 | Hill | A63F 1/14 273/149 R |
| 6,042,150 | A | 3/2000 | Daley | |
| 6,066,857 | A | 5/2000 | Fantone et al. | |
| 6,093,103 | A | 7/2000 | McCrea, Jr. | |
| 6,098,892 | A | 8/2000 | Peoples, Jr. | |
| 6,126,166 | A | 10/2000 | Lorson et al. | |
| 6,217,447 | B1 | 4/2001 | Lofink et al. | |
| 6,270,406 | B1 | 8/2001 | Sultan | |
| 6,460,848 | B1 * | 10/2002 | Soltys | G06Q 10/0639 273/149 R |
| 6,527,191 | B1 | 3/2003 | Jannersten | |
| 6,582,301 | B2 | 6/2003 | Hill | |
| 6,588,751 | B1 | 7/2003 | Grauzer et al. | |
| 6,629,894 | B1 | 10/2003 | Purton | |
| 6,637,622 | B1 | 10/2003 | Robinson | |
| 6,638,161 | B2 | 10/2003 | Soltys et al. | |
| 7,029,009 | B2 | 4/2006 | Grauzer et al. | |
| 7,093,130 | B1 | 8/2006 | Kobayashi et al. | |
| 7,172,507 | B2 | 2/2007 | Fujimoto et al. | |
| 7,222,852 | B2 | 5/2007 | Soltys et al. | |
| 7,422,522 | B2 | 9/2008 | Fujimoto et al. | |
| 7,762,468 | B2 * | 7/2010 | Jones | B41M 3/144 235/454 |
| 7,762,889 | B2 * | 7/2010 | Shigeta | A63F 1/14 273/149 R |
| 7,946,586 | B2 * | 5/2011 | Krenn | A63F 1/14 273/149 R |
| 7,967,672 | B2 | 6/2011 | Shigeta | |
| 8,221,244 | B2 * | 7/2012 | French | G07F 17/32 463/11 |
| 8,309,163 | B2 * | 11/2012 | Van Duren | C23C 18/1204 427/376.1 |
| 8,556,262 | B2 * | 10/2013 | Shigeta | A63F 1/14 273/149 R |
| 8,590,896 | B2 * | 11/2013 | Krenn | A63F 1/14 273/149 P |
| 8,801,516 | B2 | 8/2014 | Shigeta | |
| 2002/0017481 | A1 | 2/2002 | Johnson et al. | |
| 2002/0063389 | A1 | 5/2002 | Breeding et al. | |
| 2002/0068635 | A1 | 6/2002 | Hill | |
| 2002/0155869 | A1 | 10/2002 | Soltys et al. | |
| 2002/0163125 | A1 | 11/2002 | Grauzer | |
| 2002/0165029 | A1 | 11/2002 | Soltys et al. | |
| 2003/0003997 | A1 | 1/2003 | Vuong et al. | |
| 2003/0171142 | A1 | 9/2003 | Kaji et al. | |
| 2003/0176209 | A1 | 9/2003 | Soltys et al. | |
| 2003/0195025 | A1 | 10/2003 | Hill | |
| 2004/0026636 | A1 | 2/2004 | Shigeta | |
| 2004/0100026 | A1 | 5/2004 | Haggard | |
| 2005/0051955 | A1 | 3/2005 | Schubert et al. | |
| 2005/0062226 | A1 | 3/2005 | Schubert et al. | |
| 2005/0062227 | A1 | 3/2005 | Grauzer et al. | |
| 2005/0104290 | A1 | 5/2005 | Grauzer et al. | |
| 2005/0110210 | A1 | 5/2005 | Soltys et al. | |
| 2005/0121852 | A1 | 6/2005 | Soltys et al. | |
| 2005/0137005 | A1 | 6/2005 | Soltys et al. | |
| 2006/0247036 | A1 | 11/2006 | Shigeta | |
| 2007/0018389 | A1 | 1/2007 | Downs, III | |
| 2007/0216092 | A1 | 9/2007 | Fleckenstein | |
| 2008/0006997 | A1 | 1/2008 | Scheper et al. | |
| 2008/0105750 | A1 | 5/2008 | Shigeta | |
| 2008/0224394 | A1 * | 9/2008 | Shigeta | A63F 1/14 273/148 R |
| 2009/0066021 | A1 | 3/2009 | Shigeta | |
| 2009/0134575 | A1 | 5/2009 | Dickinson et al. | |
| 2009/0140492 | A1 | 6/2009 | Yoseloff et al. | |
| 2010/0276887 | A1 | 11/2010 | Yoshida | |
| 2010/0327525 | A1 | 12/2010 | Shigeta | |
| 2011/0130185 | A1 | 6/2011 | Walker | |
| 2011/0148038 | A1 | 6/2011 | Laughlin | |
| 2011/0210175 | A1 | 9/2011 | Shigeta | |
| 2012/0091656 | A1 | 4/2012 | Blaha et al. | |
| 2012/0306152 | A1 | 12/2012 | Krishnamurty et al. | |
| 2013/0207344 | A1 | 8/2013 | Shigeta | |
| 2014/0042697 | A1 | 2/2014 | Berube et al. | |
| 2015/0014925 | A1 | 1/2015 | Miller et al. | |
| 2015/0375095 | A1 | 12/2015 | Shigeta | |

FOREIGN PATENT DOCUMENTS

| | | | |
|---|---|---|---|
| CN | 101484216 | A | 7/2009 |
| CN | 101588847 | A | 11/2009 |
| CN | 101711177 | A | 5/2010 |
| CN | 101972544 | A | 2/2011 |
| CN | 202398088 | U | 8/2012 |
| GB | 2380143 | A1 | 4/2003 |
| JP | H5-398 | | 1/1993 |
| JP | H5-20512 | | 1/1993 |
| JP | H9-144353 | | 6/1997 |
| JP | H9-215812 | | 8/1997 |
| JP | H10508236 | A | 8/1998 |
| JP | 2000327255 | | 11/2000 |
| JP | 2001222687 | | 8/2001 |
| JP | 2002165916 | | 6/2002 |
| JP | 2002224443 | | 8/2002 |
| JP | 2002282413 | | 10/2002 |
| JP | 2003052902 | | 2/2003 |
| JP | 2003070956 | | 3/2003 |
| JP | 2003144742 | | 5/2003 |
| JP | 2003250950 | | 9/2003 |
| JP | 2004215806 | A | 8/2004 |
| JP | 2005198668 | | 7/2005 |
| JP | 2005267625 | | 9/2005 |
| JP | 2005296634 | A | 10/2005 |
| JP | 2007236995 | | 9/2007 |
| JP | 2008161479 | A | 7/2008 |
| JP | 2008188471 | | 8/2008 |
| JP | 2009213520 | A | 9/2009 |
| WO | 199614115 | | 5/1996 |
| WO | 199943404 | | 9/1999 |
| WO | 2001056670 | | 8/2001 |
| WO | 0205914 | A1 | 1/2002 |
| WO | 2002064225 | | 8/2002 |
| WO | 2003026763 | | 4/2003 |
| WO | 2009069708 | A1 | 6/2009 |
| WO | 2012053179 | A1 | 4/2012 |
| WO | 2012166197 | A1 | 12/2012 |
| WO | 2013116297 | A1 | 8/2013 |

OTHER PUBLICATIONS

Australian Patent Examination Report No. 1, Australian Patent Application No. 2013203316, dated Dec. 10, 2014.

(56) References Cited

OTHER PUBLICATIONS

International Search Report, International Application No. PCT/JP2013/004956, dated Sep. 24, 2013.
Australian Examiner's First Report, Australian Patent Application No. 2008200596, dated Nov. 6, 2009.
Australian Examiner's Report No. 2, Australian Patent Application No. 2010235931, dated Jul. 11, 2011.
International Preliminary Report on Patentability, International Application No. PCT/JP2005/003789, dated Feb. 2, 2006.
International Search Report, International Application No. PCT/JP2005/003789, dated Apr. 26, 2005.
Final Office Action, U.S. Appl. No. 10/542,073, dated Apr. 14, 2010.
Non-Final Office Action, U.S. Appl. No. 11/884,021, dated Dec. 8, 2010.
Non-Final Office Action, U.S. Appl. No. 11/929,727, dated Oct. 1, 2010.
Non-Final Office Action, U.S. Appl. No. 11/929,727, dated Mar. 7, 2011.
Non-Final Office Action, U.S. Appl. No. 12/231,657, dated Mar. 19, 2010.
Final Office Action, U.S. Appl. No. 12/231,657, dated Dec. 8, 2010.
Non-Final Office Action, U.S. Appl. No. 12/825,261, dated Nov. 23, 2010.
New Zealand First Examination Report, NZ Patent Application No. 704620, dated Jul. 31, 2015.
Chinese First Office Action, Chinese Patent Application No. 201310225940.6, dated Dec. 3, 2015.
New Zealand First Examination Report, NZ Patent Application No. 706311 dated Dec. 8, 2015.
Korean Office Action, Korean Patent Application No. 10-2015-7007553, dated Mar. 28, 2016.
New Zealand First Examination Report, NZ Patent Application No. 716059, dated May 6, 2016.
Australian Examination Report No. 1, Australian Patent Application No. 2015202960, dated Jun. 9, 2016.
Korean Notice of Allowance, Korean Patent Application No. 10-2015-7007316, dated Jun. 16, 2016.
Chinese Notice of Allowance, Chinese Patent Application No. 201310220992.4, dated Jul. 4, 2016.
New Zealand First Examination Report, NZ Patent Application No. 720973, dated Jul. 29, 2016.
International Search Report, European Patent Application No. 13842336.3, dated Aug. 24, 2016.

* cited by examiner

CARD SHOOTER DEVICE AND METHOD

CROSS REFERENCE TO RELATED APPLICATIONS

This application is a continuation of U.S. patent application Ser. No. 14/621,099, filed Feb. 12, 2015, which is a continuation of U.S. patent application Ser. No. 14/419,605, filed Feb. 4, 2015, which is a National Phase application under 35 U.S.C. § 371 of PCT Application PCT/JP2012/006230, filed Sep. 28, 2012. Each of the applications mentioned in this paragraph is hereby incorporated by reference.

TECHNICAL FIELD

The present invention relates to a card shoe apparatus having a function of preventing cheating in card games such as baccarat that are played using playing cards (hereinafter simply referred to as "cards") and a method.

BACKGROUND ART

Conventional card shoe apparatuses that are suitable for use in card games played in casinos or the like have been proposed. For example, a card shoe apparatus is disclosed in Patent Literature 1. In the card shoe apparatus of Patent Literature 1, a CCD image sensor and the related optical system components are incorporated in the card shoe. Also, a card reading window is provided in the exit of the card shoe. When a card passes through the exit of the shoe, the suit (type) and the rank (number) of the card are read through the card reading window.

CITATION LIST

Patent Literature 1: JP 1998-508236A (page 12, FIG. 1)

SUMMARY OF INVENTION

Problems to be Solved by the Invention

However, such a conventional apparatus could not prevent a fraudulent act such as the insertion of false cards from the exit of the card shoe.

The present invention has been made in view of the above problem, and aims to provide a card shoe and a method with which it is possible to prevent the fraudulent insertion of cards into a card shoe used in the card game or the fraudulent dealing of cards, as well as the dealing of any card that should not be dealt onto the game table.

Means for Solving the Problems

To solve the above conventional problems, the present invention provides a card shoe apparatus including:

a card housing unit for housing a plurality of cards;

an opening unit for manually taking out cards one by one from the card housing unit;

a card reading unit that reads information of a card that is manually drawn out from the card housing unit onto a game table from that card;

a control unit that stores rules of a card game and determines the winning/losing of the card game according to the rules of the card game based on the information of a card read by the card reading unit;

a display unit that outputs a winning/losing result as determined by the control unit; and a card entry/exit restriction unit that is provided in the opening unit and restricts the entry/exit of a card from the card housing unit, the card housing unit, the card reading unit, the control unit, the display unit and the card entry/exit restriction unit being configured as a single unit, wherein the card entry/exit restriction unit includes:

1) a function of prohibiting the insertion of a card that is inserted from the exterior toward the card housing unit via the opening unit in an opposite direction; and 2) a function of prohibiting, based on the information of a card read by the card reading unit, the drawing out of any additional card in a case where no additional card needs to be drawn out from the card housing unit.

Advantageous Effects of Invention

With the present invention, it is possible to provide a card shoe apparatus and a method capable of preventing, on site, any fraudulent act such as the fraudulent insertion of cards into a card shoe apparatus, false or inappropriate dealing of cards or the like.

DESCRIPTION OF EMBODIMENTS

Figure 1:
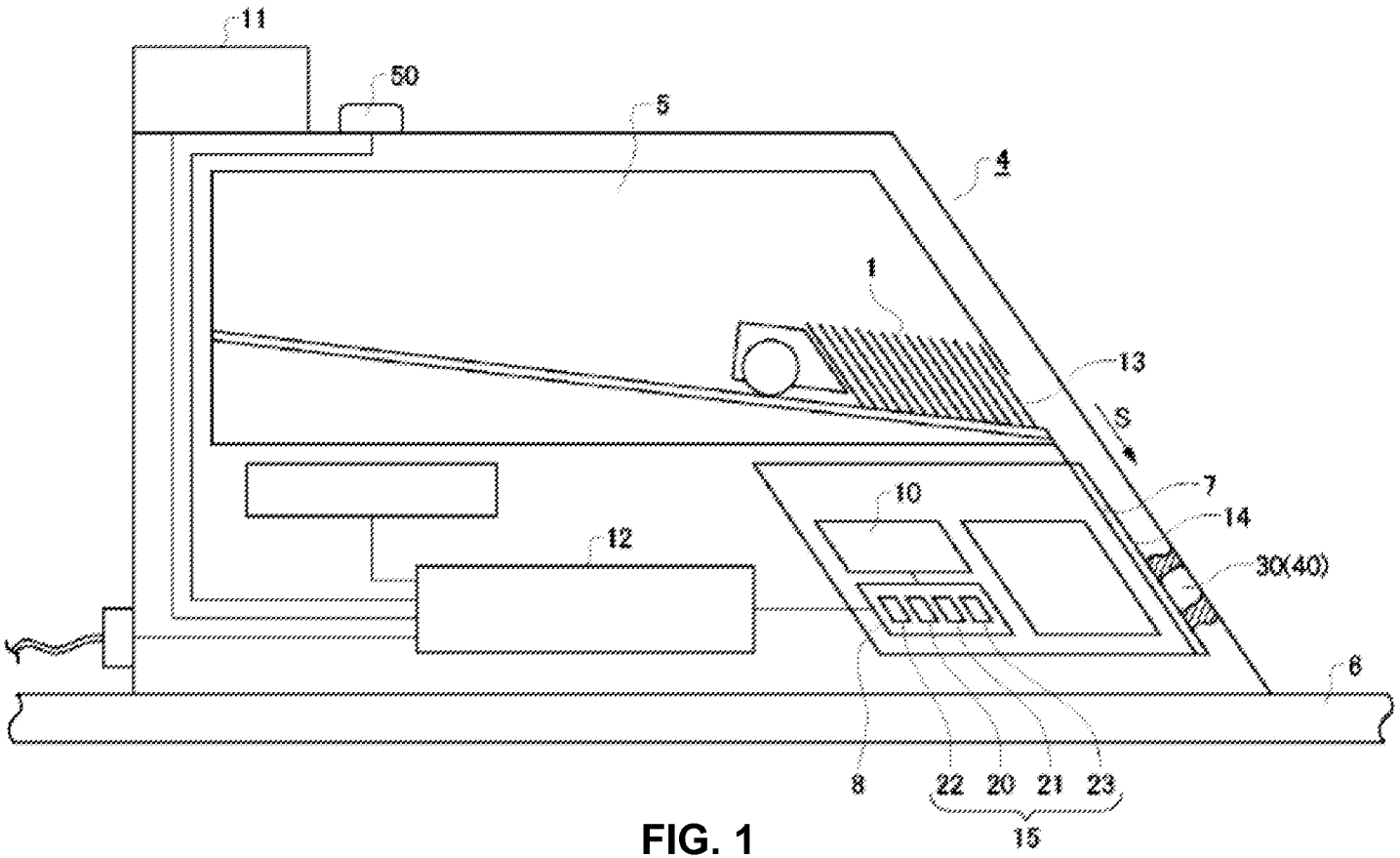
FIG. 1 is a block diagram illustrating the entirety of a card shoe apparatus according to an embodiment of the present invention.
Figure 2:
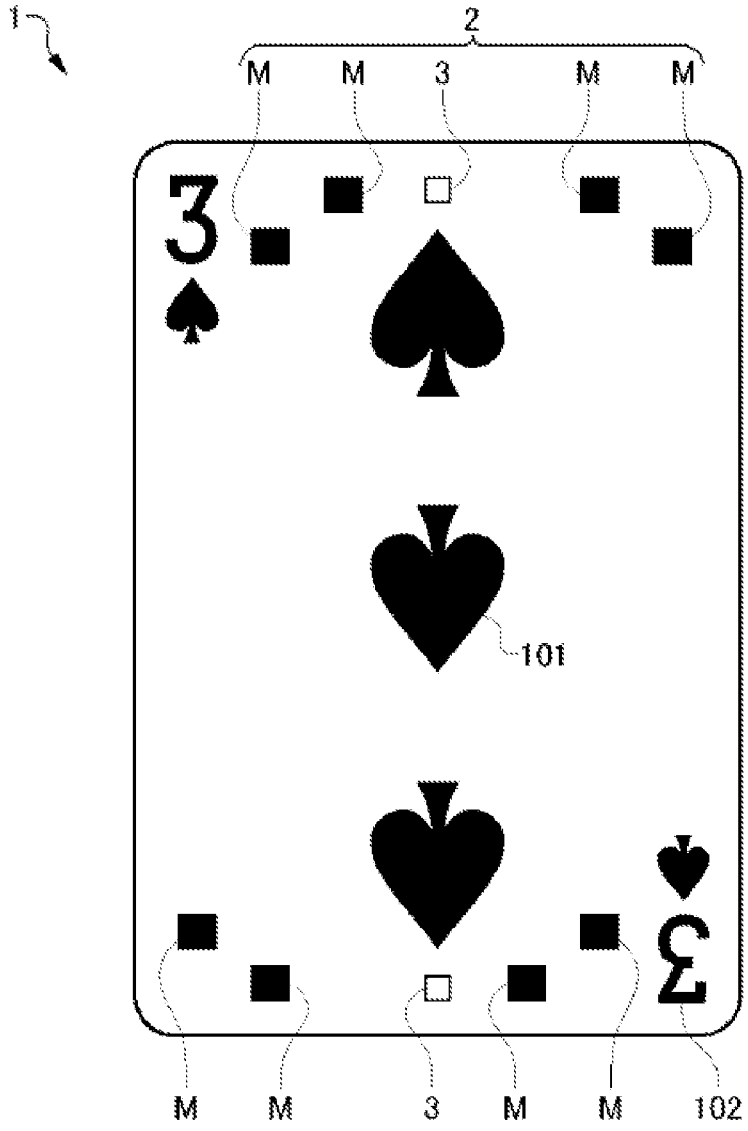
FIG. 2 shows an example of a card according to the embodiment of the present invention.

An embodiment of a table game system of the present invention will be described below in detail. FIG. 1 is a block diagram illustrating the entirety of a card shoe apparatus to be used in a table game system of the present embodiment. FIG. 2 illustrates a card 1 used in the table game system of the present embodiment. In the card 1 used in table games such as baccarat, a code 2 by which is composed of marks M that are invisible in a normal condition is provided in the upper side and the lower side of the card 1 in a point-symmetric manner. A rank (number, rank) of that card 1 is coded by the code 2. Also, the card 1 includes an authenticity determination code 3, which is created by coding information that indicates the authenticity of the card, and is arranged by printing or the like so as to be invisible in a normal condition (for example, in ultraviolet reactive ink).

In FIG. 1, a card shoe apparatus 4 includes a card guide unit 7 that guides cards 1 that are manually drawn out one by one from a card housing unit 5 onto a game table 6, a code reading unit 8 that reads, when a card 1 is manually drawn out from the card housing unit 5 by a dealer or the like of a casino, the code 2 that indicates a rank (number, rank) of that card 1, a winning/losing determination unit 10 that determines the winning/losing of the card game based on the ranks of the cards 1 sequentially read by the code reading unit 8, and an output unit 11 that outputs the result of the determination made by the winning/losing determination unit 10. The card guide unit 7 includes a card entry/exit restriction unit 30 or 40 (to be described later) that restricts the entry/exit of the card 1 from the card housing unit 5.

Figure 3:
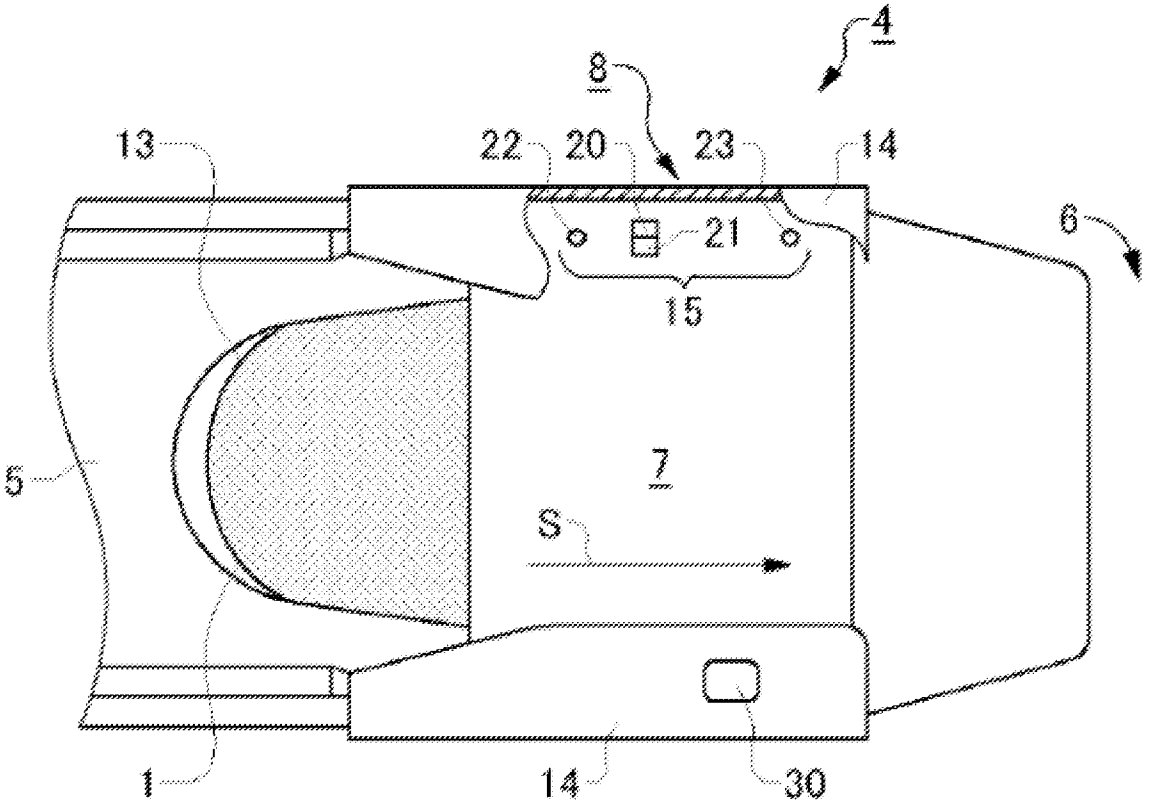
FIG. 3 is a plan view of a main portion of a card guide of the card shoe apparatus according to an embodiment of the present invention, with the card guide partially broken.

Next, the code reading unit 8 that reads, from a card 1, the code 2 that indicates a rank (number, rank) of the card 1 when the card 1 is manually drawn out from the card housing unit 5 will be described in detail with reference to FIG. 3. FIG. 3 is a plan view of a main portion of the card shoe apparatus 4. In FIG. 3, the code reading unit 8 is provided in the card guide unit 7 that guides the cards 1 manually taken out one by one from an opening 13 onto the game table 6, with the opening 13 provided in a front portion of the card housing unit 5. The card guide unit 7 is an inclined surface, and a card guide 14 is attached to an edge portion of each of both sides thereof, with the card guide 14 also serving as a sensor cover. Also, two card guides 14 are each configured to be attachable/detachable with screws or the like (not shown). When a card guide 14 is removed, a sensor group 15 of the code reading unit 8 is exposed. The sensor group 15 is composed of four sensors, including two ultraviolet reactive sensors (UV sensors) 20 and 21, and object detection sensors 22 and 23.

The object detection sensors 22 and 23 are optical fiber sensors that each detect the presence of the card 1, and are capable of detecting movement of the card 1. The object detection sensor 22 is placed in the upstream side of the card guide unit 7 with respect to the travel direction of the card 1, and the object detection sensor 23 is placed in the downstream side of the card guide unit 7 with respect to the travel direction of the card 1. As shown in FIG. 3, the object detection sensors 22 and 23 are respectively provided in the upstream side and the downstream side of the UV sensors 20 and 21. The UV sensors 20 and 21 each include an LED (UV LED) that emits an ultraviolet ray and a detector. The marks M of the code 2 are printed on the card 1 in UV luminescent ink that emits color when UV ray is applied. The card 1 is irradiated with the UV ray (black light), and the detector detects the light reflected by the marks M of the code 2 of the card 1. The UV sensors 20 and 21 are connected to a control apparatus 12 of the code reading unit 8 via a cable. In the code reading unit 8, the arrangement patterns of the marks M are determined based on the output signals from the detectors of the UV sensors 20 and 21, such that the number (rank) corresponding to the code 2 is determined.

In the code reading unit 8, the start and end of the reading performed by the UV sensors 20 and 21 are controlled by the control apparatus 12 based on the detection signals from the object detection sensors 22 and 23. Also, the control apparatus 12 determines whether the card 1 has normally passed through the card guide unit 7 based on the detection signals from the object detection sensors 22 and 23. As shown in FIG. 2, the rectangular marks M are arranged within a framework of two rows with four columns on each of the upper and bottom edges of a card, and the arrangement of such marks indicates the rank (number) and the suit (Heart, Spade or the like) of the card. When the UV sensor(s) 20 and/or 21 detect(s) a mark M, such UV sensor(s) output(s) an on signal. The code reading unit 8 determines the relative relation between the signals received from the two UV sensors 20 and 21. In this way, the code reading unit 8 identifies the code based on the relative difference or the like between the two marks M detected by the two UV sensors 20 and 21, thereby identifying the number (rank) and the type (suit) of the corresponding card 1.

Figure 5:
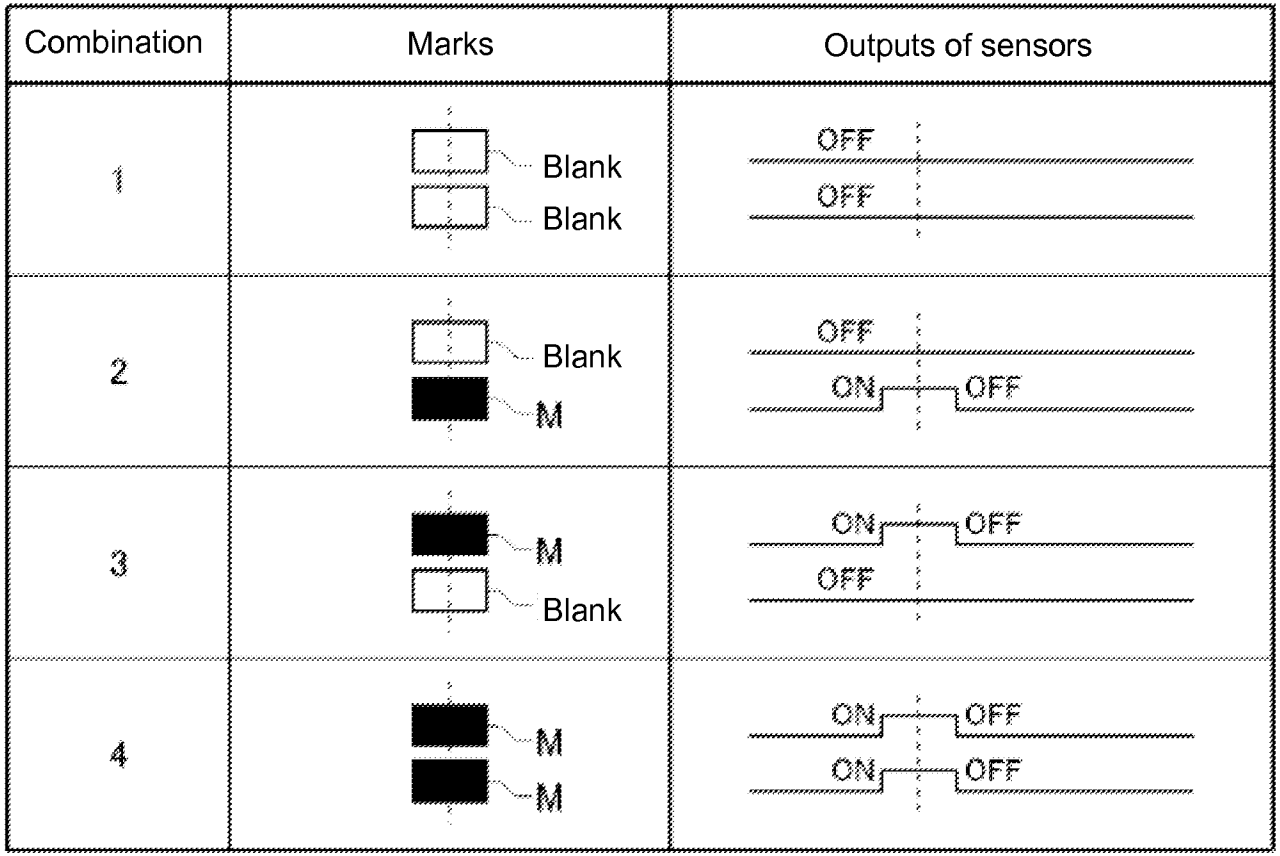
FIG. 5 is a diagram illustrating the relation between output waves from sensors and marks with the card shoe apparatus according to an embodiment of the present invention.

The relation between the code 2 and the output of the on signals from the two UV sensors 20 and 21 are shown in FIG. 5. It is possible to identify a predetermined arrangement pattern of the marks M based on the comparison results of the relative changes in the output of the on signals from the UV sensors 20 and 21. As a result, in two rows (the upper and lower rows), four types of arrangement patterns of the mark M are possible, and since patterns are printed in four columns, it is possible to form 256 types of codes (4×4×4×4). Fifty two (52) playing cards are each assigned to one of the 256 codes, and the relations of such assignment are stored in a memory or by a program as an association table. A configuration is thereby adopted in which the card reading unit 8 can, by identifying the code 2, identify the number (rank) and the type (suit) of the card 1 based on that predetermined association table (not shown). Also, 52 cards can be freely associated with 52 codes out of the 256 codes to be stored in the association table, and thus, there will be a variety of associations between them. Therefore, it is possible to change the associations between the 256 codes and 52 cards depending on the time or place. Preferably, the code is printed with a paint material that becomes visible when irradiated with UV ray, and placed in a position where it does not overlap the indications of the card types or indexes 102.

Next, the configuration of the control apparatus 12 will be described. The control apparatus 12, the code reading unit 8, the winning/losing determination unit 10 and the like are realized by a computer apparatus. For example, the function of automatically determining the winning/losing of a game (the winning/losing determination unit 10) is realized by installing a program for determining the winning/losing in a computer, and that program is executed by a processor of the computer. The ranks of cards sequentially taken out onto the game table 6 are acquired using the UV sensors 20 and 21 in the code reading unit 8, and the ranks of cards thus acquired are sequentially stored in a memory. At this time, information on which card 1 is dealt to which player is also stored. The number of each card is stored in association with the player to whom that card was dealt. In baccarat, there is a player and a banker. The rank (number) of the card dealt is stored in the memory in association with the player to whom it was dealt, and the ranks (number) of the cards dealt are added for each player, and the winner is determined based on the programmed rules. A "tie" is also judged.

Figure 4:
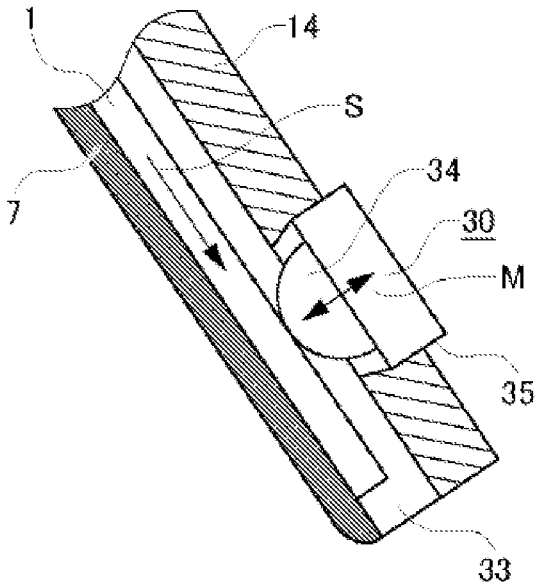
FIG. 4(*a*) is a cross-sectional view illustrating a main portion of a card entry/exit restriction unit that restricts the entry/exit of cards from a card housing unit of the card shoe apparatus according to an embodiment of the present invention as viewed from the side, and FIG. 4(*b*) is a cross-sectional view illustrating a main portion of a variation of the card entry/exit restriction unit that restricts the entry/exit of cards from a card housing unit of the card shoe apparatus according to an embodiment of the present invention as viewed from the side.
Figure 4:
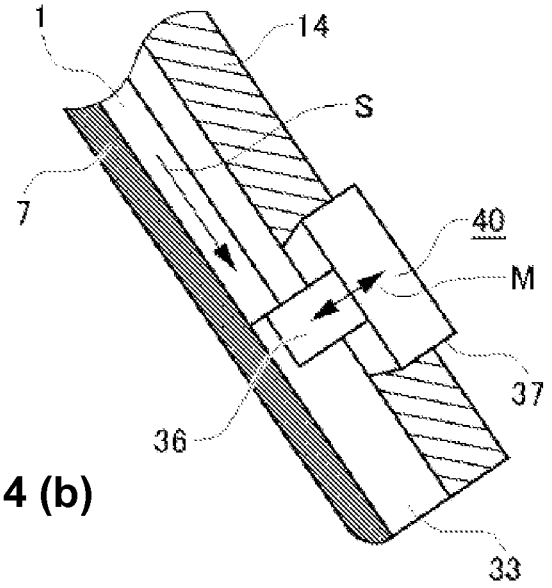

Next, the card entry/exit restriction unit 30 that restricts the entry/exit of the card 1 to/from the card housing unit 5 will be described with reference to FIG. 4. In FIG. 4(*a*), the card entry/exit restriction unit 30 is provided in the card guide 14 of the card guide unit 7 that guides the cards 1 taken out one by one from the opening 13, which is provided in a front portion of the card housing unit 5, onto the game table 6. The card entry/exit restriction unit 30 has a structure by which when a card 1 passes through a slot 33 between the card guide unit 7 and the guide cover of the card guide 14, a lock member 34 presses the card 1 to prohibit the entry/exit of the card 1 within the slot 33. The lock member 34 is capable of moving in the direction indicated by the arrow M by a driving unit 35 composed of an electromagnetic solenoid, a piezoelectric device or the like, such that it can take two positions, namely, a position where the card 1 is pressed (restricted position) and a position where the card 1 is allowed to pass through. The driving unit 35 is controlled by the control apparatus 12, and causes the lock member 34 to move to two positions, namely, a position where the card 1 is pressed and a position where the card 1 is allowed to pass through. The rules of the baccarat game are programmed and stored in advance in the control apparatus 12.

Next, a variation of the card entry/exit restriction unit 30 will be described with reference to FIG. 4(*b*). A card entry/exit restriction unit 40 of the variation has a structure by which when a card 1 passes through the slot 33 between the card guide unit 7 and the guide cover of the card guide 14, a lock member 36 protrudes into the slot 33 to prohibit movement of the card 1. The lock member 36 is capable of moving in the direction indicated by the arrow M by a driving unit 37 composed of an electromagnetic solenoid, a piezoelectric device or the like, such that it can take two positions, namely, a position where movement of the card 1 is prohibited (restricted position) and a position where the card 1 is allowed to pass through. The driving unit 37 is controlled by the control apparatus 12, and causes the lock member 36 to move to two positions, namely, a position where movement of the card 1 is prohibited and a position where the card 1 is allowed to pass through.

The card entry/exit restriction unit 30 (40) is caused to function as a result of the driving unit 35 or 37 being controlled by the program of the control apparatus 12 to prevent the fraudulent entry/exit of the card 1. The card entry/exit restriction unit 30 (40) is provided with the object detection sensors 22 and 23 as sensors for detecting movement of the card 1, and has a function of detecting movement of the card 1 with these sensors 22 and 23 to restrict such movement. The details of the control (programmed control) performed for preventing the fraudulent entry/exit of the card 1 includes at least the following 1) and 2):

1) A function of prohibiting the insertion of a card 1 that is inserted in the direction opposite to the direction of the arrow S, namely, from the exterior toward the card housing unit 5 via the opening 13.

In this case, although the card 1 inserted for the purpose of cheating passes through the slot 33 between the card guide unit 7 and the card guide 14, the movement of the card 1 in a direction opposite to the normal direction (the direction opposite to the arrow S in FIG. 3) is detected based on the detection signals from the object detection sensors 22 and 23, and due to the program of the control apparatus 12, the driving units 35 or 37 will move their corresponding lock members 34 or 36 to their respective positions of pressing or blocking the card 1, respectively.

2) A function of prohibiting the drawing of a card 1 from the card housing unit 5 when such drawing should not be allowed based on the information on the suits and the ranks of the cards 1 read by a card reading unit (this means the code reading unit 8 that reads from a card 1 the code 2 that indicates a rank (number, rank) of that card 1 when the card 1 is drawn out from the card housing unit 5).

In this case, as described above, the rules of the baccarat game are programmed in advance in the control apparatus 12. In the baccarat game, whether each of the banker and the player should draw two or more cards 1 is uniquely determined according to the total of the ranks (numbers) of the two cards already dealt to each of them. Thus, if the dealer of a table attempts to deal a card 1 in a case where the third card should not be drawn, which is against the rules, movement of the card 1 is restricted. If drawing of the card 1 is attempted at a time or state when such drawing should not be allowed, movement of the card 1 is detected based on the signals of the detection of the card 1 given by the object detection sensor 22, and the driving units 35 or 37 will move their corresponding lock members 34 or 36 to their respective positions of pressing or blocking the card 1, respectively by the program of the control apparatus 12. In this manner, the lock members 34 or 36 will move to their respective positions of pressing or blocking the card 1, respectively, thereby prohibiting the dealing of additional cards 1 (the positions shown in FIG. 4). In this way, the attitude of dealing a card 1 by the dealer which is against the rules is detected, and the dealing of the card 1 is restricted, thus an apparatus that restricts the entry/exit of the card 1 gets used up more slowly than the case of blocking the card 1 at every end of the games.

An error signal output unit 50, which, upon the operation of the card entry/exit restriction unit 30 (40), gives an external signal regarding such operation (a lamp is illuminated and an alarm sound is emitted), is provided, and the operation of which is controlled by the control apparatus 12.

INDUSTRIAL APPLICABILITY

As described above, the card shoe apparatus of the present invention has an effect on being capable of preventing, on site, any fraudulent act such as the fraudulent insertion of cards into a card shoe apparatus, false or inappropriate dealing of cards, or the like. Thus the card shoe apparatus of the present invention is used in card games played in casinos, and effective.

REFERENCE SIGNS LIST

1 card
2 code
3 authenticity determination code
4 card shoe apparatus
5 card housing unit
6 game table
7 card guide unit
8 code reading unit
10 winning/losing determination unit
11 output unit
12 control apparatus
13 opening
14 card guide
15 sensor group
20 ultraviolet reactive sensor (UV sensor)
21 ultraviolet reactive sensor (UV sensor)
22 object detection sensor
23 object detection sensor
30 card entry/exit restriction unit
33 slot
34 lock member
35 driving unit
36 lock member
37 driving unit
40 card entry/exit restriction unit
50 error signal output unit
102 index

The invention claimed is:

1. A card shoe apparatus comprising:

a card housing for housing a plurality of cards and that includes an opening for manually withdrawing the cards one by one from the card housing in a first direction;

an optical device;

a card entry/exit restriction unit provided in the opening; and a control unit, wherein the control unit is configured to trigger the card entry/exit restriction unit to restrict entry or exit of one or more of the cards responsive to detection, using the optical device, of a card movement in a second direction that is opposite to the first direction.

2. A card shoe apparatus according to claim 1, further comprising an error signal output unit that, when the card entry/exit restriction unit operates to perform the restriction, signals the operation of the card entry/exit restriction unit.

3. A card shoe apparatus according to claim 1, wherein the optical device comprises one or more fiber optic sensors.

4. A card shoe apparatus according to claim 1, wherein the card entry/exit restriction unit further comprises a lock member.

5. A card shoe apparatus according to claim 4, wherein, when the card entry/exit restriction unit operates to perform the restriction, the restriction prevents a card at the opening from being moved in the first direction.

6. A card shoe apparatus according to claim 4, further comprising a card guide unit in the opening that guides the cards manually withdrawn from the card housing, wherein the card entry/exit restriction unit is configured to perform the restriction by the lock member pressing one of the cards in a direction towards the card guide unit.

7. A card shoe apparatus according to claim 4, wherein the lock member is movable in a direction perpendicular to the first direction.

8. A card shoe apparatus according to claim 1, further comprising a card reader, wherein the card reader is configured to read invisible codes on one or more of the cards as the cards are manually withdrawn from the card housing in the first direction.

9. A card shoe apparatus according to claim 8, wherein the invisible codes, which the card reader is configured to read to obtain information about the cards, are placed on upper and lower sides of the read cards in a symmetrical arrangement.

10. A card shoe apparatus according to claim 8, wherein the invisible codes are invisible to the human eye when visible light is applied to the cards.

11. A card shoe apparatus according to claim 8, wherein the card reader is configured to additionally read an authenticity determination code on one or more of the cards.

12. A card shoe apparatus according to claim 1, further comprising:

a card reader, wherein:

the card reader is configured to read information on the cards as the cards are manually withdrawn from the card housing; and the control unit stores rules of a card game and is configured to determine a result of the card game based on (a) the stored rules and (b) the information read by the card reader.

13. A card shoe apparatus comprising:

a card housing for housing a plurality of cards and that includes an opening for manually withdrawing the cards one by one from the card housing in a first direction;

a card entry/exit restriction unit provided in the opening; and a control unit, wherein the control unit is configured to trigger the card entry/exit restriction unit to restrict any of the cards from entering into the card housing or exiting from the card housing responsive to detection by the control unit of improper card withdrawal from the opening.

14. A card shoe apparatus according to claim 13, wherein the detected improper withdrawal, in response to which the control unit is configured to trigger the card entry/exit restriction unit to perform the restriction, is a withdrawal of one or more of the cards that is prohibited by game rules stored by the control unit.

15. A card shoe apparatus according to claim 13, wherein the detected improper withdrawal, in response to which the control unit is configured to trigger the card entry/exit restriction unit to perform the restriction, is a detected movement of one or more of the cards in a second direction that is opposite to the first direction.

16. A card shoe apparatus according to claim 13, wherein the detected improper withdrawal, in response to which the control unit is configured to trigger the card entry/exit restriction unit to perform the restriction, is a detected movement of one or more of the cards relative to the first direction.

17. A card shoe apparatus comprising:

a card housing for housing a plurality of cards and that includes an opening for manually withdrawing the cards one by one from the card housing in a first direction;

a card reader;

a card entry/exit restriction unit provided in the opening; and a control unit, wherein the control unit is configured to trigger the card entry/exit restriction unit to restrict any of the cards from entering into the card housing or exiting from the card housing responsive to output from the card reader regarding information on one or more of the cards that is read by the card reader as the one or more of the cards are manually withdrawn from the card housing in the first direction.

18. A card shoe apparatus according to claim 13, further comprising an error signal output unit that when the card entry/exit restriction unit operates to perform the restriction, signals the operation of the card entry/exit restriction unit.

19. A card shoe apparatus according to claim 13, further comprising an optical device that comprises one or more fiber optic sensors by which the optical device is configured to detect movements of the cards relative to the first direction and according to which detection the control unit is configured to operate the card entry/exit restriction unit.

20. A card shoe apparatus according to claim 13, wherein the card entry/exit restriction unit comprises a lock member.

21. A card shoe apparatus according to claim 20, wherein, when the card entry/exit restriction unit operates to perform the restriction, the restriction prevents a card at the opening from being moved in the first direction.

22. A card shoe apparatus according to claim 20, further comprising a card guide unit in the opening that guides the cards manually withdrawn from the card housing, wherein the card entry/exit restriction unit is configured to perform the restriction by the lock member pressing one of the cards in a direction towards the card guide unit.

23. A card shoe apparatus according to claim 20, wherein the lock member is movable in a direction perpendicular to the first direction.

24. A card shoe apparatus according to claim 13, wherein the card reader is configured to read the information by reading invisible codes on one or more of the cards.

25. A card shoe apparatus according to claim 24, wherein the invisible codes are invisible to the human eye when visible light is applied to the cards.

26. A card shoe apparatus according to claim 24, wherein the invisible codes, which the card reader is configured to read to obtain the information, are placed on upper and lower sides of the read cards in a symmetrical arrangement.

27. A card shoe apparatus according to claim 24, wherein the card reader is further configured to read an authenticity determination code on one or more of the cards.

* * * * *